US005232225A

United States Patent [19]

Snyder

[11] Patent Number: 5,232,225

[45] Date of Patent: Aug. 3, 1993

[54] GOLF CLUB GRIP POSITIONING AID

[76] Inventor: Stephen J. Snyder, P.O. Box 1078, Osprey, Fla. 34229

[21] Appl. No.: 988,903

[22] Filed: Nov. 4, 1992

Related U.S. Application Data

[63] Continuation of Ser. No. 800,257, Nov. 29, 1991, abandoned.

[51] Int. Cl.[5] ..... A63B 69/36

[52] U.S. Cl. ..... 273/187.2; 273/189 R; 273/166; 2/161.3; 2/917

[58] Field of Search ..... 273/187.2, 166, DIG. 30, 273/189 R; 2/161 A

[56] References Cited

U.S. PATENT DOCUMENTS

| | | | |
|---|---|---|---|
| 3,508,280 | 4/1970 | Osborn | 273/166 X |
| 3,532,344 | 10/1970 | Masstab | 273/166 |
| 4,665,565 | 5/1987 | Odom | 273/DIG. 30 |
| 5,028,050 | 7/1991 | Freyer | 273/DIG. 30 |
| 5,184,827 | 2/1993 | Suttle et al. | 273/DIG. 30 |

*Primary Examiner*—George J. Marlo
*Attorney, Agent, or Firm*—Robert F. Meyer

[57] ABSTRACT

A pair of gloves and the handle of a golf club include self-gripping tape which forms a tenacious bond when engaged. Patches of such tape are located on inner surfaces of an end of each thumb of each glove, only at knuckles of at least three fingers of one glove, and only at knuckles of the second glove. Additional coacting patches of such tape are located on the palm of the second glove at the base of the thumb, and on the back of the thumb of the first glove.

3 Claims, 2 Drawing Sheets

GOLF CLUB GRIP POSITIONING AID

This application is a continuation of U.S. application Ser. No. 07/800,257, filed Nov. 29, 1991 now abandoned.

BACKGROUND OF THE INVENTION

The present invention relates to gripping means and more particularly to such gripping means that will aid a player in properly gripping ball hitting equipment.

It is well known that one of the important aspects of developing a good golf, tennis, racquet ball, or baseball swing is having a proper hand grip for holding a golf club, tennis racquet, racquet ball racquet, and a baseball bat. For example, while a proper golf grip can be described and shown to a golfer, it would be far better to have a means available which could aid a student golfer in maintaining a proper grip on the club while the golfer is actually swinging and attempting to hit a golf ball. The same is also true for baseball, tennis, or racquet ball.

SUMMARY OF THE INVENTION

Accordingly, there is provided in the present invention a gripping means for a ball hitting means that is adapted to aid a player in maintaining a proper grip on the ball hitting means which in general comprises a gripping means for a ball hitting means taken from the class consisting of gloves and handles of the ball hitting means, the gripping means including first bonding means located thereon at at least one position defining a proper grip location for aiding in properly placing a handle in a players hand and adapted to mate with a second bonding means carried by another gripping means at a proper position, the other gripping means taken from the same class.

DETAILED DESCRIPTION OF THE INVENTION

Figure 1:
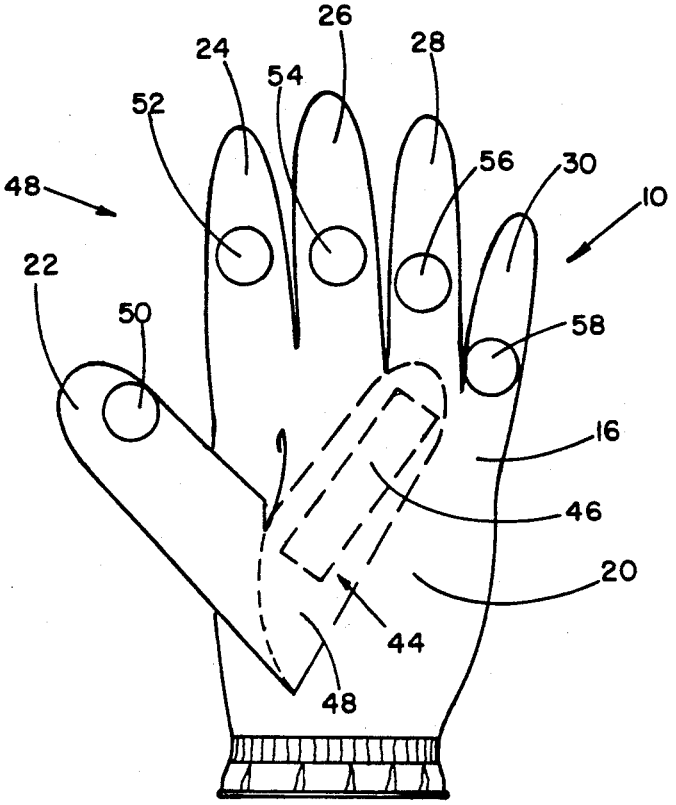
FIG. 1 is a view of a left handed golf glove showing one embodiment of the invention.
Figure 2:
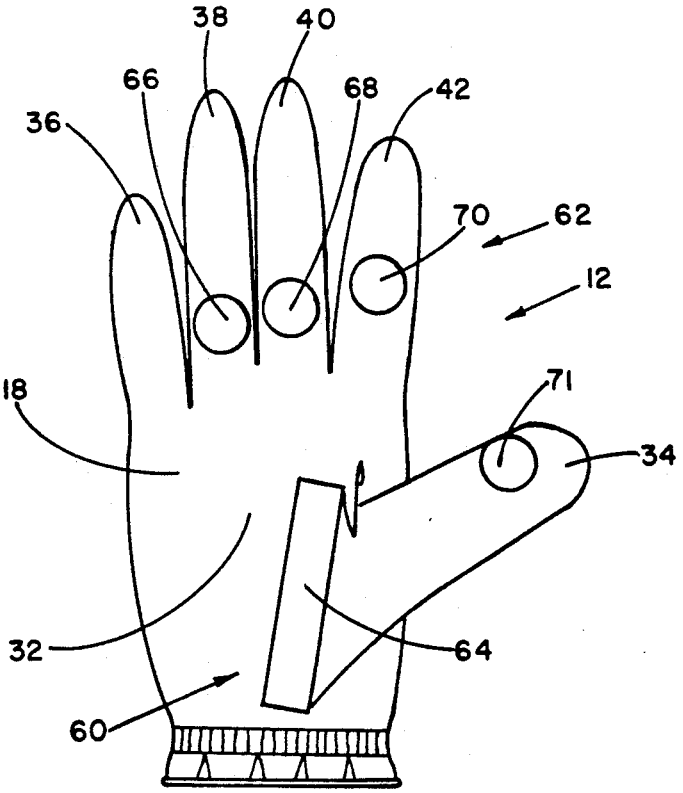
FIG. 2 is a view of a right handed golf glove showing another embodiment of the invention.

Referring now to the drawings, and in particular FIGS. 1 and 2, there is shown golf club gripping means 10 and 12 which includes golf gloves 16 and 18. FIG. 1 illustrates a glove 16 for a left hand which includes a portion covering a palm 20 a sheath 22 covering a thumb and individual sheath covering individual fingers 24, 26, 28 and 30. FIG. 2 illustrates a golf glove 18 for the right hand. It too includes a palm portion 32, a sheath 34 covering a thumb and individual sheaths covering fingers 36, 38, 40 and 42. The gloves are typically made of a soft leather which does not readily stiffen upon drying after being wet. Gloves marketed by the Wilson Company would be suitable, for example.

In accordance with an embodiment of the invention there is provided a bonding means on each of the gloves which cooperate with each other to provide a tenacious bond which tends to hold the gloves together. As shown in FIG. 1 bonding means 44 includes a self-gripping tape 46 that is attached to an outer surface 48 of sheath 22 with the tape extending along the length of the sheath; that is the length of the thumb. Bonding means 48 includes individual tapes 50, 52, 54, 56 and 58 attached to the inner surfaces of the sheaths for the thumb and individual fingers. The tapes are, as shown, circular spots which are located on the inner surface of the sheaths at the knuckles of the fingers and at the end of the thumb on the inner surface of its sheath. The tapes are also of the self-gripping type.

Referring to FIG. 2, there is shown bonding means 60 and 62 that are carried by the right handed glove 18. Bonding means 60 includes a self-gripping tape 64 that is carried lengthwise in the palm portion 32 of the glove along the base of the thumb 34. Bonding means 62 includes circular self-gripping tapes 66, 68, 70, and 71 located on the inner sheaths at the knuckles of the fingers and at the end of the thumb on the inner surface of its sheath. For reasons that will be apparent hereafter, there is no tape on the sheath for the little finger 36.

Figure 3:
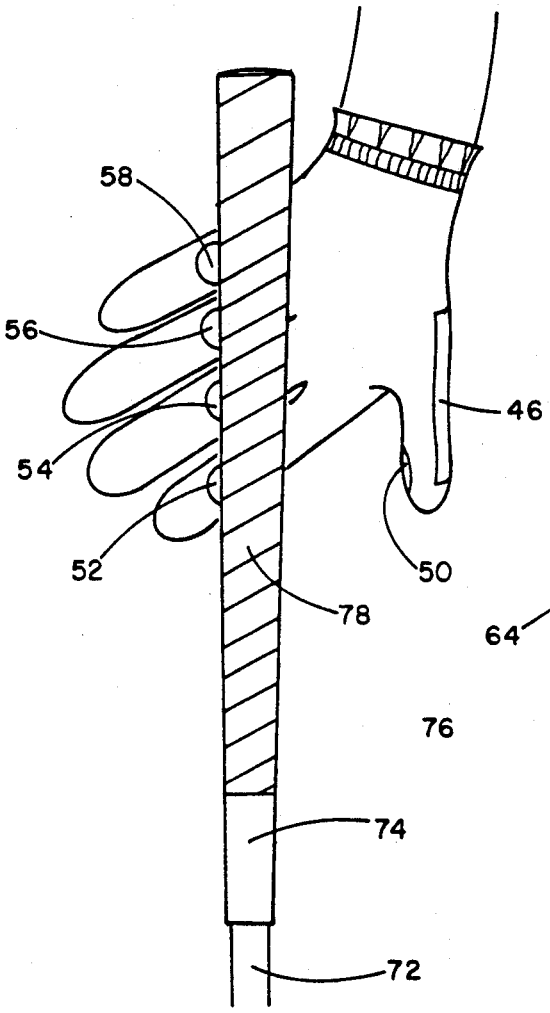
FIG. 3 is a view of a golf club and golf glove showing the relationship of the glove to the golf club.

Referring now to FIG. 3, there is shown a portion of a golf club 72 which serves as the handle or grip 74 for the club. A bonding means 76 includes a self-gripping tape 78 which is wrapped around the grip 74 of the club. In the alternative the self-gripping tape could serve as the grip portion itself.

The self-gripping tapes of the present invention are of the type marketed by Velcro USA Inc. of Manchester, N.H. The self-gripping tapes are used on most if not all of the golf gloves used today as a means for aiding in securing the glove on the hand at the wrists as partially indicated at 65, FIG. 4. Such use does not form any part of the present invention. As will be described hereinafter the tapes work in pairs to effectuate a tenacious bond between the two. More specifically, one of the tapes has a surface which is composed of "hooks" while the other tape which is composed of "loops". When the two surfaces are meshed together the loops intermesh with the hooks to provide a tenacious bonding. The tapes may be attached to the gloves and the club shaft by some suitable means such as by sewing, basting, or gluing for example.

Figure 4:
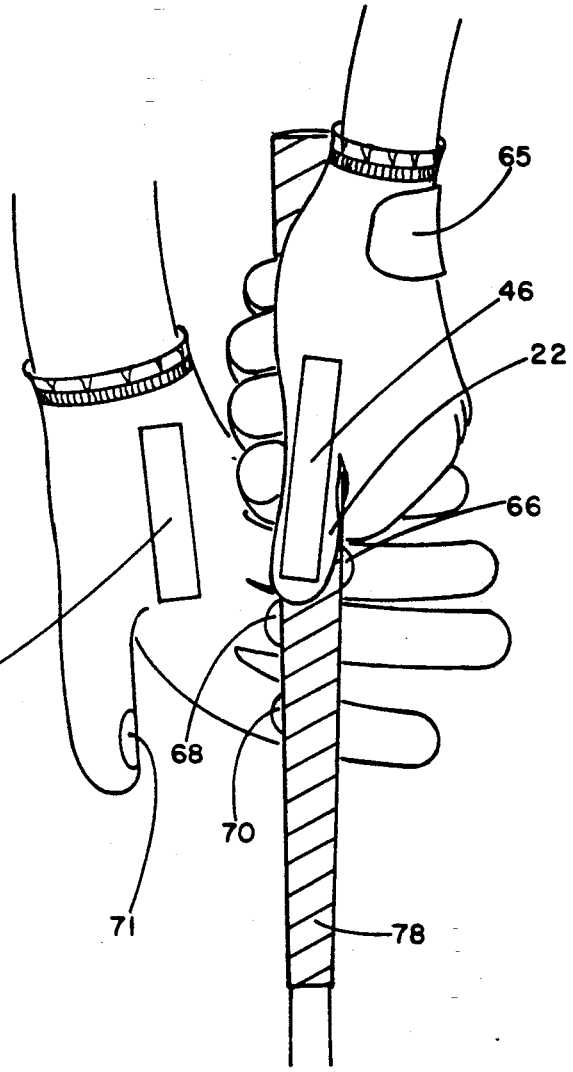
FIG. 4 is a view of a golf club and the relation of the club to the right and left handed golf gloves of FIG. 1 and 2.

FIGS. 3 and 4 illustrates the use of the tapes to achieve and maintain a proper grip by a golfer on a golf club as the club is swung by the golfer. Referring to FIG. 3, the glove of FIG. 1 for the left hand is shown being placed in proper location on the grip of the club shaft. In this illustration, the tape 78 on the golf club has the loop surface while the tapes 52, 54, 56, and 58 have the hook surface. When the club is gripped as shown in FIG. 4, a bond is made between the tapes to aid in maintaining a proper grip with respect to the fingers of the left hand. At the same time, when the thumb 22 is placed in position tape 50 becomes bonded with the grip 78. Also, tape 46 is placed in position to receive and form a bond with tape 64 when the right hand is laid over to complete the grip. Since tape 78 has the hook surface the surfaces of tapes 52, 54, 56 and 58 will have loop surfaces. Likewise on of the tapes of 46 or 64 will have a hook surface while the other will have a loop surface.

Further when the right hand is laid over to complete the grip and the finger of the right closed around the club shaft, a tenacious bond will be made between grip 78 and tapes 66, 68 and 70. There is no tape on the little finger 36 because of the overlapping of the finger with the left hand which is a grip common among golfers.

It is apparent that when the hands are placed on the golf club with the tapes held in a proper position and mating each other, a proper golf grip is achieved and, due to the tenacious bond achieved by the cooperating tapes, the grip can be maintained during a golf swing.

Figure 5:
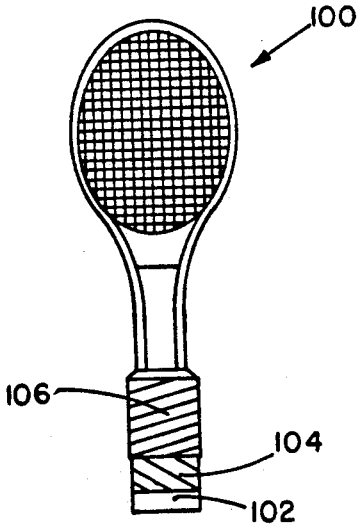
FIG. 5 is is a view of a tennis racquet and/or a racquet ball racquet.

FIG. 5 illustrates a tennis racquet or a racquet ball racquet 100 using a bonding means of the invention. The racquet includes a handle 102 having a grip 104 to which a self-gripping tape 106 of the invention is applied. Then either the gloves of the left hand of FIG. 1 having the tapes of 52, 54, 56, and 58 or the glove of the right hand of FIG. 2 having the tapes of 66, 68, 70 and 71 as well as a tape for the little finger 36 can be fitted over the handle to form a tenacious bond between the tapes and tape 106. If desired both hands can be used together.

Figure 6:
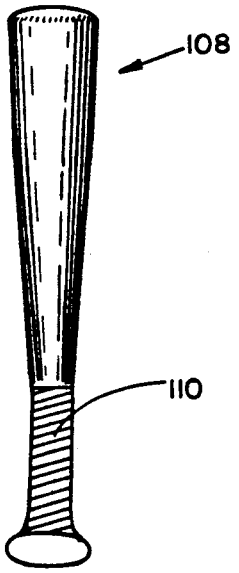
FIG. 6 is a view of a baseball bat.

Referring to FIG. 6, both the left or right handed gloves with their tapes can be used to grip baseball bat 108 to form a tenacious bond with a self-gripping tape 110 carried by the handle 112 of the bat.

As illustrated in the present embodiments of the invention, the gripping means is described for a right handed player. The invention is also applicable for a left handed player with the locations of the tapes being reversed.

What is claimed is:

1. Gripping means for gripping a handle of a golf club comprising:

a first glove having first bonding means located on inner surfaces of sheathes of fingers only at knuckles of said fingers and second bonding means located at an end of a sheath of a thumb on its inner surface, a second glove having third bonding means located on inner surfaces of sheaths only at knuckles of at least three fingers, fourth bonding means located at an end of a sheath of a thumb on its inner surface, and said first, second, third and fourth bonding means adapted to engage a fifth bonding means on said handle to form a tenacious bond therewith.

2. A gripping means according to claim 1 wherein said third bonding means is located on three fingers other than the little finger.

3. A gripping means according to claim 1 wherein said first glove includes sixth bonding means located on a backside surface of a sheath of said thumb, and seventh bonding means located on an inner surface of a palm of second glove at a base of said said thumb, whereby when said gloves are placed on said handle said seventh bonding means overlaps and engages said sixth bonding means to form a tenacious bond there between.

* * * * *